US005704070A

United States Patent [19]

Stogner

[11] Patent Number: 5,704,070

[45] Date of Patent: Jan. 6, 1998

[54] CAP FOR HEAD WEAR HAVING AN INTERNAL POCKET

[76] Inventor: Richard L. Stogner, 11301 Pencross Ct., Louisville, Ky. 40223

[21] Appl. No.: 687,320

[22] Filed: Aug. 14, 1996

[51] Int. Cl.[6] ..... A42B 1/24

[52] U.S. Cl. ..... 2/209.13; 2/181.2; 2/181; 2/175.1; 2/195.1

[58] Field of Search ..... 2/171, 10, 171.1, 2/171.4, 171.8, 173.5, 181.2, 181.4, 181.6, 181.8, 182.1, 182.2, 182.3, 182.5, 182.8, 183, 209.12, 209.13, 209.4, 495.1, 195.2, 200.1, 181, 175.1

[56] References Cited

U.S. PATENT DOCUMENTS

| | | | |
|---|---|---|---|
| D. 160,404 | 11/1950 | Levine . | |
| 1,190,427 | 7/1916 | Kromer, Jr. . | |
| 1,808,966 | 6/1931 | Morgan . | |
| 2,744,256 | 5/1956 | Slotkin et al. . | |
| 3,128,474 | 4/1964 | Feldman . | |
| 4,312,076 | 1/1982 | Gamm . | |
| 4,386,437 | 6/1983 | Fosher . | |
| 4,586,280 | 5/1986 | Dane . | |
| 4,776,043 | 10/1988 | Coleman . | |
| 4,873,726 | 10/1989 | Tapia . | |
| 4,989,270 | 2/1991 | Boughten | 2/195.1 |
| 5,070,545 | 12/1991 | Tapia . | |
| 5,075,898 | 12/1991 | Bedient . | |
| 5,111,366 | 5/1992 | Rife et al. . | |
| 5,119,514 | 6/1992 | Woehl . | |
| 5,136,726 | 8/1992 | Kellin et al. . | |
| 5,167,559 | 12/1992 | Power-Fardy . | |
| 5,214,802 | 6/1993 | McCallum . | |
| 5,233,703 | 8/1993 | Galka . | |
| 5,367,713 | 11/1994 | McCallum . | |
| 5,410,761 | 5/1995 | Connelly et al. . | |
| 5,428,844 | 7/1995 | Dougherty . | |
| 5,452,479 | 9/1995 | Mostert . | |
| 5,465,426 | 11/1995 | Beaton . | |
| 5,509,145 | 4/1996 | Stevenson et al. | 2/209.7 |

*Primary Examiner*—Jeanette E. Chapman

*Attorney, Agent, or Firm*—Middleton & Reutlinger; James C. Eaves, Jr.; Charles G. Lamb

[57] ABSTRACT

A cap for head wear is provided with a pocket on an interior surface of a crown portion of the cap. The pocket is defined by attaching pocket panels along the interior surface of a front portion of the crown wherein the pocket extends from a top of the crown toward a sweat band at the base of the crown. The opening into the pocket is adjacent to and spaced from the sweat band.

10 Claims, 2 Drawing Sheets

CAP FOR HEAD WEAR HAVING AN INTERNAL POCKET

BACKGROUND OF THE INVENTION

This invention relates to a cap for head wear having internal pockets and particularly to a baseball-type cap having advertising indicia on internal pockets of the cap.

Baseball-type caps have been commercially available for a number of years and have acquired popularity not only in the outdoor playing of baseball but also in the pursuit of other outdoor activities. In recent years, when caps are worn with pocketless shirts and pants or shorts or the garments have pockets which are otherwise undesirable for the placing of keys, drivers license, fishing license, and the like therein, there has been considerable interest in attaching pockets to the caps. For example, U.S. Pat. No. 4,386,437 teaches a baseball-type cap having an interior pocket attached to the inside of the cap which extends upwardly within a space between the head of the wearer and the inside of the cap, the pocket having a top entering opening. U.S. Pat. No. 5,214,802 and U.S. Pat. No. 5,367,713 teach a convertible hat and bag assembly wherein a bag shape enclosure is stowed inside the hat and usable for storage or converting into a bag.

SUMMARY OF THE INVENTION

An object of the present invention is to provide a cap for head wear having an internal pocket.

It is another object of the present invention to provide an interior pocket in a cap for head wear which is easily and simply constructed.

It is a further object of the present invention to provide a baseball-type cap having an interior pocket fixedly attached to the inner surface of the head wear.

It is an even further object of the present invention to provide a baseball-type cap having air vents therein on sides and back of the cap with an interior pocket fixedly attached along the interior surface of a front portion of the cap.

It is also an object of the present invention to provide an internal-pocket in a baseball-type cap having an opening adjacent to but spaced from a sweat band affixed to the lower interior surface of the cap.

More particularly, the present invention provides a cap for head wear comprising at least five triangular-shaped cap panels attached along their side portions to provide to head-shaped configuration, each of the cap panels having a base portion, each of the cap panels having an inner surface and an outer surface, at least three of the cap panels is provided with air vents therein and at least two of the remaining cap panels is of buckram and form a front section of the cap. A sweat band is provided to circumscribe the inner surfaces of the cap panels adjacent to the base portions of the panels. The front section has an outwardly extending visor attached thereto. At least one pocket panel is provided which attaches to and covers the inner surface of the at least two cap panels forming the front section, the at least one pocket panel being attached along its side edges to an inner surface thereby defining a pocket with an opening adjacent to the sweat band, the opening being spaced upwardly from the sweat band.

Other objects and features of the present invention will be apparent to those skilled in the art upon reading the description of the preferred embodiment as set forth hereinafter.

DESCRIPTION OF THE PREFERRED EMBODIMENT

Figure 1:
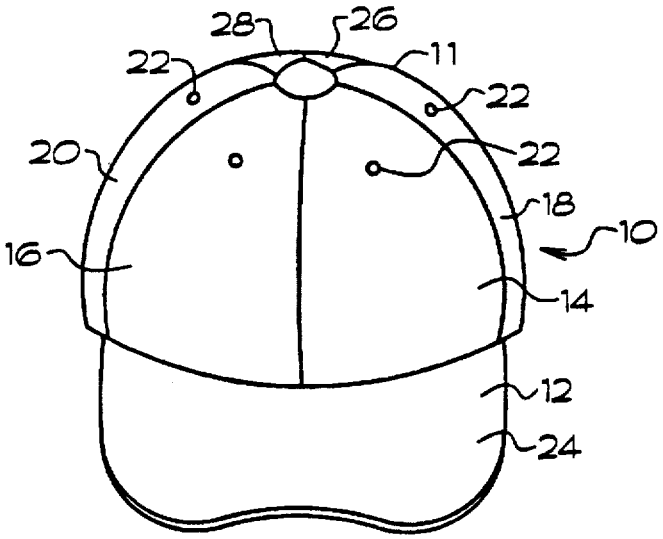
FIG. 1 is a front view showing a cap of the present invention.
Figure 2:
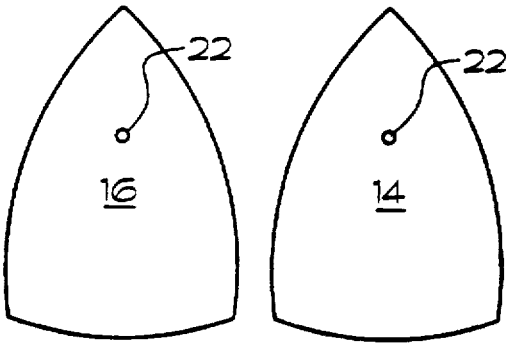
FIG. 2 is a plan view of two front cap panels of the cap of FIG. 1.
Figure 3:
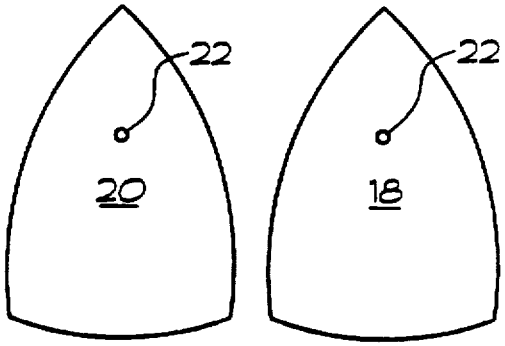
FIG. 3 is a plan view of two side cap panels of the cap of FIG. 1.
Figure 4:
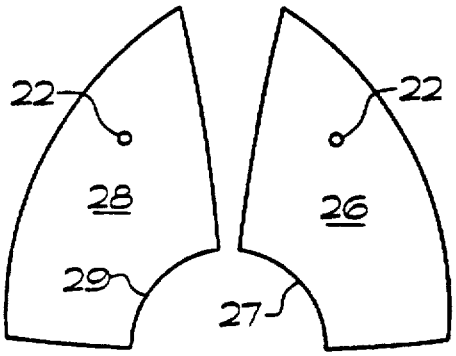
FIG. 4 is a plan view of two back cap panels of the cap of FIG. 1.

Referring to FIG. 1 of the drawings, a cap for head wear is shown as a baseball-type cap 10 which includes a crown portion 11 and an outwardly extending visor 12 attached thereto. Air vents 22 are also provided. The crown 11 is made up of a plurality of cap panels as shown in FIGS. 2, 3 and 4. A front section of the crown 11 is made up of two triangular-shaped buckram front cap panels 14 and 16, triangular-shaped side cap panels 18 and 20 on opposite sides of the crown and two triangular-shaped back cap panels 26 and 28. The side cap panels 18 and 20 and the back cap panels 26 and 28 are generally made from a soft flexible cloth or mesh-like material. Also, as best shown in FIG. 4, arcuate sections 27 and 29 are cut out of the triangular-shaped back cap panels 26 and 28, respectively, to provide connecting cut-out portions for taking up and letting out the length of an adjustable strap, as discussed hereinafter.

Figure 5:
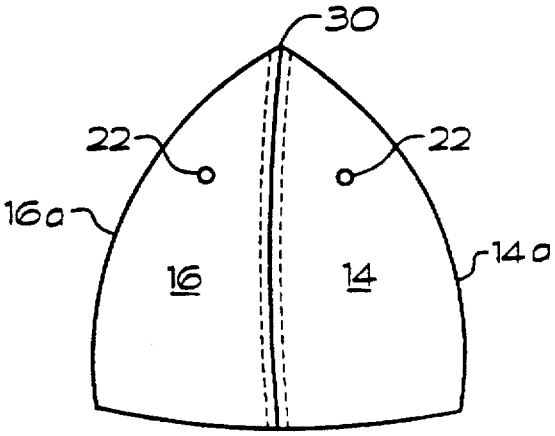
FIG. 5 is a plan view of the two front cap panels of FIG. 2 shown in a joined arrangement.

All of the cap panels are joined together generally by a single stitch sewing machine and in FIG. 5 is shown the joining of the front panels 14 and 16 with a single needle lock stitch sewing machine. The remaining panels 18, 20, 26, 28 are also joined in the same manner, usually with a single needle lock stitch sewing machine.

Figure 6:
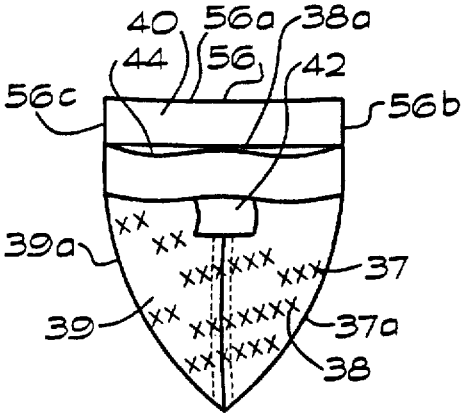
FIG. 6 is a plan view of an internal pocket of the present invention.
Figure 10:
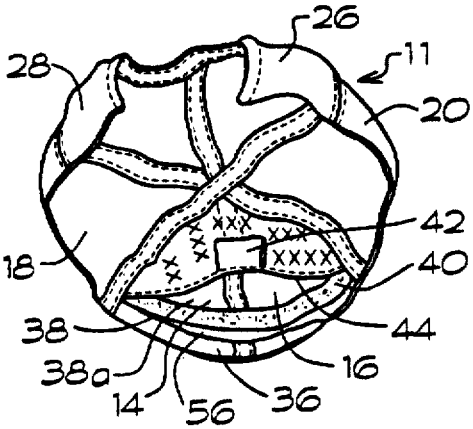
FIG. 10 is a perspective view of the inside of the cap of FIG. 1.

In FIG. 6 is shown the inside of the front portion of the crown of the cap wherein a pocket 38 is shown. The pocket 38 is generally of pie-shape configuration and formed by the joining of outer pocket panels 37 and 39 which are of triangular-shape and sized substantially the same as the front cap panels 14 and 16. The outer pocket panels 37 and 39 at their outer curved edges **37*a* and 39*a*, respectively, are attached to the outer curved edges 14*a* and 16*a* (FIG. 5) of the two front cap panels 14 and 16, respectively. Again, single needle stitching is generally used to attach the pocket panels 37 and 39 to the cap panels 14 and 16 thereby providing an opening 38*a* for the pocket 38. Means are provided along the opening 38*a* for opening and closing the opening. As shown, along the opening 38*a* is provided mating VELCRO fastening strips 40 and 44 which are used to open and close the opening 38*a*. The VELCRO fastening strip 40 is attached to a longitudinally extending strip of material 56 which has terminating ends 56b and 56c terminating in alignment with the cap panel edges 39a and 37a. A longitudinal base edge 56a of the strip 56 is attached along the base portion of the panels 14 and 16 so that the defined pocket 38 is spaced upwardly from visor 12 of the cap. Also, the width of the strip of material 56 is greater than the sweat band 36 (FIG. 10) so that the opening 38a into the pocket 38 is spaced above the sweat band 36. As shown in FIG. 6, the outer surface of the pocket 38 may be provided with advertising indicia and the like thereon. Also, a pull tab 42 is attached along one edge of opening 38a for assisting in unhooking the VELCRO fastening strips 40 and 44 thereby providing for easy opening of the pocket 38. The interior pocket 38 in the crown 11 is generally of sufficient size to hold keys, drivers license and spending money by taking advantage of the space between the crown and the head of the wearer. Also by attaching the edge of the pocket panels 37 and 39, as best shown in FIG. 10, the pocket 38 takes up very little room and does not interfere in any way with the wearer of the cap 10**.

Figure 6A:
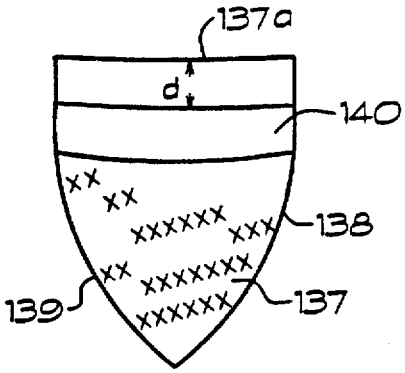
FIG. 6A is a plan view of internal pocket panels for another internal pocket of the present invention.

An alternative pocket to the pocket 38 shown in FIG. 6 may include an inner pocket panel 137 to which pocket panels 37 and 39 are attached. As shown in FIG. 6A, inner pocket panel 137 of pie-shaped configuration includes a VELCRO fastening strip 140, which is mateable with VELCRO fastening strip 44, at a preselected distance "d" from the longitudinal edge 137a. The preselected distance "d" is generally equal to the width of a sweat band 35 plus at least an additional one-quarter of an inch. In the use of the panel 137, the pocket panels 37 and 39 are attached along their outer edges 37a and 39a to the outer curved edges 138, 139 of panel 137, leaving the base portion open thereby forming an opening into the resulting pocket. The resulting pocket is then attached to the outer curved edges 14a and 16a of the front cap panels 14 and 16, respectively. Moreover, the outer surface of the inner pocket panel 137 may include advertising indicia or the like thereon.

Figure 7:
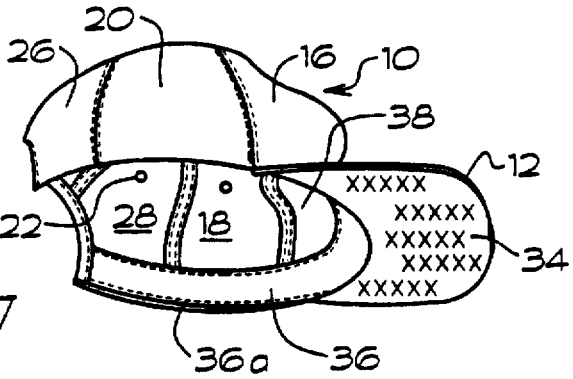
FIG. 7 is a perspective view shown from an underside of the cap of FIG. 1.

As shown in FIG. 7, the sweat band 36 is sewn to the inside of the crown 11 around the lower edges of the front, side and back cap panels. As shown, a seam 36a attaches the sweat band to the lower edges or along the bases of the panels with a gap being left at the semi-circular opening defined between the edges of the back cap panels 26 and 28. Also, the underside 34 of the visor 12 may include advertising indicia or the like thereon.

Figure 8:
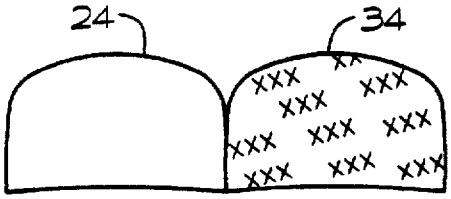
FIG. 8 is a plan view showing an upper surface visor panel and an under surface visor panel of the cap shown in FIG. 1.
Figure 9:
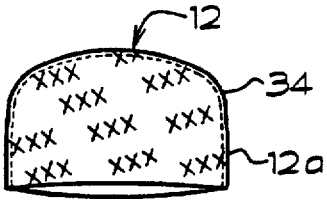
FIG. 9 is a plan view showing the upper surface visor panel and the under surface visor panel joined together.

FIGS. 8 and 9 show the visor panel 12 being in two outer sections, one identified as the upper visor panel section 24 and the under visor panel section 34. The two outer visor panel sections are generally made of cloth and a plastic insert (not shown) is generally inserted between the two panels prior to being joined together by single needle stitching as shown in the stitch lines 12a in FIG. 9.

In FIG. 10 is shown the inside of the crown 11 which shows the pocket 38 in an open position and showing the spacing of the opening 38a upwardly from the top of the sweat band 36. Generally, the spacing is at least one-quarter of an inch from the top of the sweat band 36.

Figure 11:
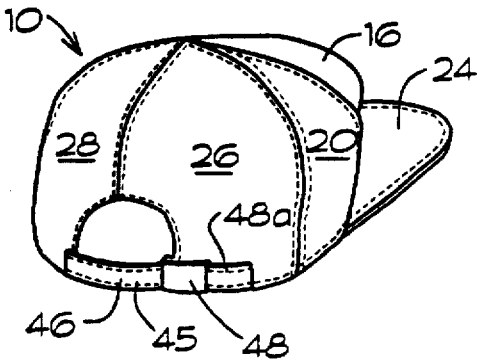
FIG. 11 is a perspective view from the back of the cap of FIG. 1.

As shown in FIG. 11, the cap 10 is provided with an adjustable strap assembly 45 connecting the back cap panels 26 and 28. As shown, the adjustable strap assembly 45 consists of an elongated adjustable strap 46 attached to panel 28 and a buckle 48 attached to a short flexible strap 48a which is in turn attached to the panel 26. It is realized that only one type of an adjustable strap assembly 45 is shown, but it is realized that other adjustable strap assemblies, such as an adjustment snap tab, may be utilized so that the cap 10 can be adjusted for a variable number of head sizes.

It is realized that various changes may be made in the aforedescribed embodiment without departing from the scope and spirit of the present invention as set forth in the claims appended hereto.

What is claimed is:

1. A cap for head wear comprising:

at least five triangular-shaped cap panels attached along side portions to form a crown, each of said cap panels having a base portion, each of said cap panels having an inner surface and an outer surface, at least three of said cap panels having air vents therein;

a sweat band circumscribing said inner surfaces of said cap panels adjacent said base portions of said cap panels and attached thereto;

two of said cap panels forming a front section of said cap, said front section being buckram;

an outwardly extending visor attached to said front section; and, a pocket, said pocket defined by an inner pocket panel sized to cover the inner surface of said two cap panels forming said front section and an outer pocket panel having outer edges aligned with and attached to outer edges of said inner pocket panel, said inner pocket panel having a base portion of greater width than a base portion of said outer pocket panel, said greater width being greater than a width of said sweat band.

2. The cap of claim 1 including a pair of mating hook and loop fastening strips disposed along said opening to said pocket for opening and closing said pocket.

3. The cap of claim 1 including advertising indicia on an outer surface of said pocket.

4. The cap of claim 1 including advertising indicia on an under surface of said visor.

5. The cap of claim 1 wherein two of said triangular-shaped cap panels being back cap panels, said two back cap panels forming a back section having cut outs therein with a semi-circular cut out at the juncture of said two said back cap panels.

6. The cap of claim 5 including an adjustable belt assembly attached on opposite sides of said semi-circular cut out.

7. The cap of claim 1, said spacing between said pocket opening and said sweat band being at least one-quarter of a inch.

8. The cap of claim 1 having two front cap panels, two side cap panels and two back cap panels, each of said side cap panels and said back cap panels having air vents therein.

9. The cap of claim 1, said pocket defined by an outer pocket panel sized to cover the inner surface of said two cap panels forming said front section, said outer pocket panel being attached along its outer edges to outer edges of said front sections.

10. The cap of claim 1, said base portion of said inner pocket panel and said base portion of said outer pocket panel defining an opening in said pocket.

* * * * *